United States Patent [19]

Demizu

[11] Patent Number: 4,934,349

[45] Date of Patent: Jun. 19, 1990

[54] GLOW PLUG CONTROLLING APPARATUS FOR A DIESEL ENGINE

[75] Inventor: Akira Demizu, Himeji, Japan

[73] Assignee: Mitsubishi Denki Kabushiki Kaisha, Tokyo, Japan

[21] Appl. No.: 177,948

[22] Filed: Apr. 5, 1988

[30] Foreign Application Priority Data

Apr. 22, 1987 [JP] Japan ..... 62-100651

[51] Int. Cl.[5] ..... F02P 19/02

[52] U.S. Cl. ..... 123/179 H; 123/145 A; 219/497

[58] Field of Search ..... 123/179 H, 179 B, 179 BG, 123/145 A; 219/494, 497

[56] References Cited

U.S. PATENT DOCUMENTS

| | | | |
|---|---|---|---|
| 4,377,138 | 3/1983 | Mitani et al. | 123/179 H |
| 4,399,781 | 8/1983 | Tsukasaki | 123/179 H |
| 4,566,410 | 1/1986 | Demizu | 123/179 H |

FOREIGN PATENT DOCUMENTS

| | | | |
|---|---|---|---|
| 2827928 | 6/1978 | Fed. Rep. of Germany . | |
| 2847097 | 10/1978 | Fed. Rep. of Germany . | |
| 2926844 | 2/1980 | Fed. Rep. of Germany . | |
| 57-81162 | 5/1982 | Japan . | |
| 58-210373 | 12/1983 | Japan | 123/179 B |
| 59-708 | 1/1984 | Japan . | |
| 59-122779 | 7/1984 | Japan | 123/179 BG |
| 60-35177 | 2/1985 | Japan | 123/145 A |

*Primary Examiner*—Andrew M. Dolinar

*Attorney, Agent, or Firm*—Oblon, Spivak, McClelland, Maier & Neustadt

[57] ABSTRACT

A glow plug controlling apparatus for a diesel engine comprises a glow plug having a predetermined resistance-temperature characteristic which is mounted on the diesel engine and in which a rated value of voltage applied thereto is determined to be lower than a power source voltage, a quick preheating circuit comprising a first switch connected in series between said glow plug and a power source, a stable preheating circuit comprising a serial connection of a resistor and a second switch which is connected in parallel to the quick preheating circuit, a voltage detecting means for detecting a voltage applied to the glow plug when the second switch of the stable preheating circuit is closed, and a driving signal controlling means for determining a driving time to drive the second switch in response to an output from the voltage detecting means.

4 Claims, 6 Drawing Sheets

GLOW PLUG CONTROLLING APPARATUS FOR A DIESEL ENGINE

BACKGROUND OF THE INVENTION

1. Field of the Invention

The present invention relates to a glow plug controlling apparatus for a diesel engine which is capable of detecting with high accuracy an upper limit temperature when a glow plug is heated in a stable preheating operation by detecting a voltage applied to the plug without using a temperature detecting means.

2. Discussion of Background

As a conventional engine preheating control apparatus with a glow plug for preheating a diesel engine, there has been known one as disclosed in Japanese Examined Patent Publication No. 708/1984. In the conventional apparatus disclosed in the publication, a plug current detecting resistor is connected in series to a glow plug in a current feeding circuit; a voltage across the resistor is detected by a bridge circuit so that a value of resistance corresponding to the temperature of the glow plug is detected in a stable preheating operation.

More specifically, a voltage is applied to the glow plug for preheating the engine which is formed by a heating body having a predetermined resistance-temperature coefficient from a d.c. power source via a switching means and a stable preheating resistor. A detecting resistor is inserted in the above-mentioned circuit to cause voltage drop in proportion to a current flowing in the glow plug. The value of voltage drop is detected by a temperature detector to generate an electric signal in proportion to the temperature of the diesel engine. A controlling means receives the electric signal of the temperature detector, a signal from a start detection means for detecting the operational condition of the engine and a signal corresponding to the voltage drop resulted in the detecting resistor, whereby the controlling means controls switching operations between a first current conducting condition in which the stable preheating resistor is short-circuited and a second current conducting condition in which the glow plug is supplied with a current from the d.c. power source through the stable preheating resistor.

However, in the conventional glow plug control apparatus adapted to detect a resistance value depending on the temperature of the glow plug, it is necessary to use a resistor free from deviation in resistance values to detect the resistance values precisely. Further, wiring operations for the controlling means is complicated and there causes loss of electric power in the resistor.

SUMMARY OF THE INVENTION

It is an object of the present invention to provide a glow plug controlling apparatus for a diesel engine of a simple structure which detects with accuracy the upper limit temperature of a glow plug in a stable preheating operation and which controls the temperature of the glow plug to be low when an excessive voltage exceeding a normal voltage range is applied to the glow plug.

The foregoing and the other objects of the present invention have been attained by providing a glow plug controlling apparatus for a diesel engine comprises a glow plug having a predetermined resistance-temperature characteristic which is mounted on the diesel engine and in which a rated value of voltage applied thereto is determined to be lower than a power source voltage, a quick preheating circuit comprising a first switch connected in series between the glow plug and a power source, a stable preheating circuit comprising a serial connection of a resistor and a second switch which is connected is parallel to the quick preheating circuit, a voltage detecting means for detecting a voltage applied to the glow plug when the second switch of the stable preheating circuit is closed, and a driving signal controlling means for determining a driving time to drive the second switch element in response to an output from the voltage detecting means.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
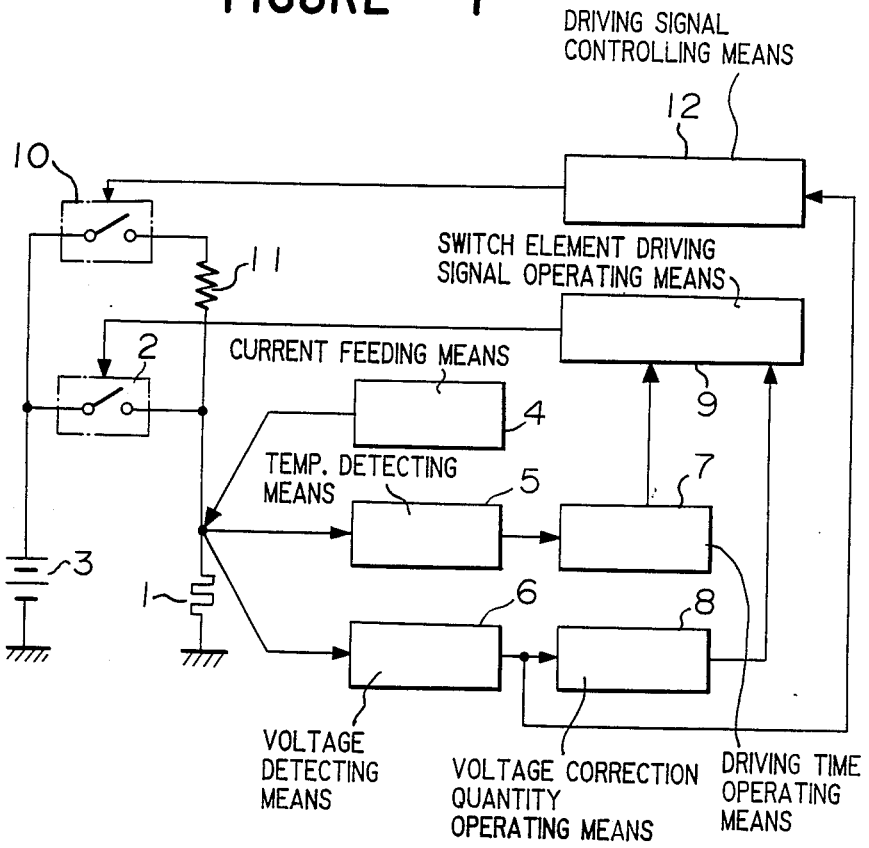
FIG. 1 is a block diagram showing an embodiment of the glow plug control apparatus for a diesel engine according to the present invention.

Referring to the drawings, wherein the same reference numerals designate the same or corresponding parts throughout the several views, and more particularly to FIG. 1 thereof, there is shown a block diagram of an embodiment of the glow plug controlling apparatus for a diesel engine of the present invention. In FIG. 1, a reference numeral 1 designates a glow plug having a predetermined resistance-temperature characteristic which is mounted on a diesel engine (not shown). One terminal of the glow plug is grounded and the other is connected to the positive terminal of a battery through a first switch element 2. The negative terminal of the battery 3 is grounded. Namely, the switch element 2 is inserted in a current feeding circuit to the glow plug 1 in series to the battery 3 as a d.c. power source.

A numeral 4 designates a power supplying means to feed a detecting current to the glow plug 1 when the switch element 2 is opened, and a numeral 5 designates a temperature detecting means for detecting the temperature of the glow plug 1 on the basis of voltage drop in the glow plug 1. The output of the temperature detecting means 5 is supplied to a driving time operating means 7. The driving time operating means 7 operates a current feeding time in order to elevate the temperature of the glow plug 1 to a predetermined value depending on the output of the temperature detecting means 5, and the output as a result of the operation is outputted to a switch element driving signal operating means 9.

On the other hand, a voltage detecting means 6 is to detect a voltage applied to the glow plug 1 when the switch element 2 is closed, and the output of the voltage detecting means 6 is received by a voltage correction quantity operating means 8. The voltage correction quantity operating means 8 operates to obtain a corrected quantity with respect to a current feeding time to the glow plug 1 depending on the output of the voltage detecting means 6, and a signal as a result of the operation is outputted to a switch element driving signal operating means 9. The switch element driving signal operating means 9 determines a driving time for the switch element 2 depending on the outputs of the driving time operating means 7 and the voltage correction quantity operating means 8.

A stable preheating circuit consisting of a serial connection of a second switch element 10 and a resistor 11 is connected between the battery 3 and the glow plug 1 in parallel to the first switch element 2. The second switch element 10 is opened and closed depending on the operating time determined by a driving signal controlling means 12. The driving signal controlling means 12 determines a driving time for the second switch element 10 in response to the output of the voltage detecting means 6.

In the glow plug controlling apparatus having the above-mentioned construction, a constant electric current is supplied to the glow plug 1 from the power supplying means 4 when the first and second switch elements 2, 10 are opened. The constant electric current causes voltage drop by the glow plug resistance which is based upon its temperature. The temperature of the glow plug 1 is detected by the temperature detecting means 5. A signal produced as a result of the detection is outputted to the driving time operating means 7 in which a reference driving time is calculated.

The reference driving time calculated by the driving time operating means 7 is outputted to the switch element driving signal operating means 9, whereby the switch element 2 is closed, and a voltage is applied to the glow plug 1 from the battery 3. The voltage applied to the glow plug 1 is detected by the voltage detecting means 6. The detected output of the voltage detecting means 6 is supplied to the voltage correction quantity operating means 8 and the driving signal controlling means 12. The voltage correction quantity operating means 8 calculates a corrected quantity of voltage in the reference driving time for the glow plug 1 depending on the detected output of the voltage detecting means 6, and a signal produced as a result of the calculation is outputted to the switch element driving signal operating means 9. Then, the switch element driving signal operating means 9 determines a current feeding time to the glow plug by taking the corrected voltage in addition to the reference driving time, and the first switch element 2 is closed by the switch element driving signal operating means 9 for the current feeding time thus calculated. When the first switch element 2 is closed, an excessive amount of voltage which is higher than the rated voltage is applied to the glow plug 1 from the battery 3 via the first switch element 2, whereby the glow plug 1 is rapidly heated.

Figure 2:
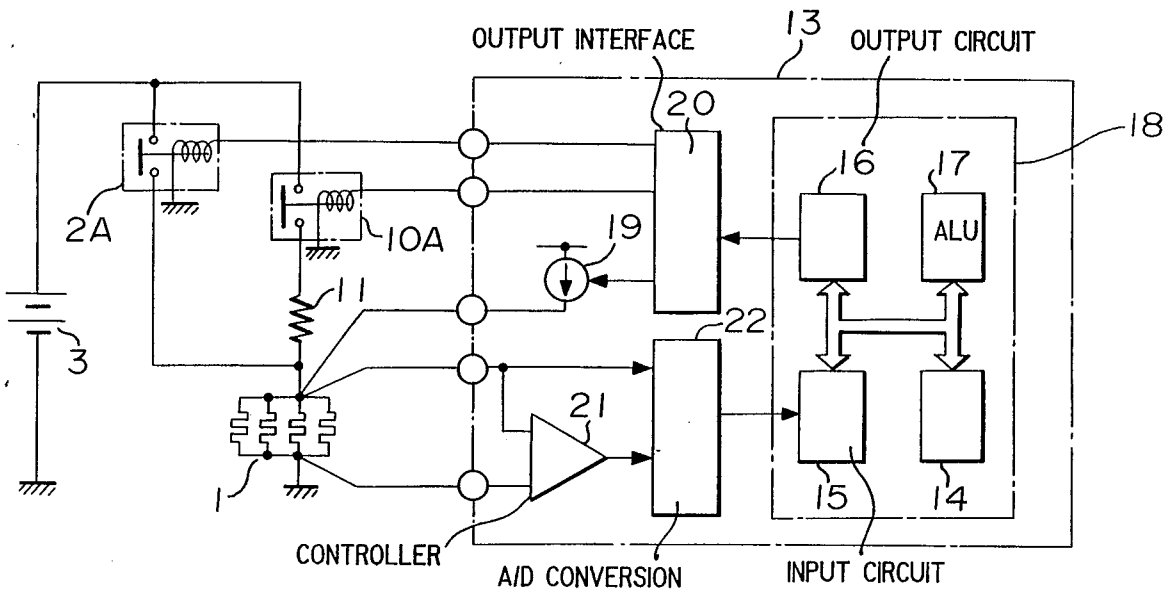
FIG. 2 is a block diagram showing the detailed construction of the embodiment shown in FIG. 1.

FIG. 2 is a block diagram showing in more detail an embodiment of the glow plug control apparatus of the present invention. In FIG. 2, the same reference numerals designates the same or corresponding parts In FIG. 2, a numeral 2A designates a glow relay as the first switch element and a numeral 10A designates a glow relay as the second switch element 10.

A numeral 13 designates a controller which is formed by the power supplying means 4, the switch element driving signal operating means 9 and the driving signal controlling means 12 as in FIG. 1.

The controller 13 comprises a microcomputer 18, an output interface 20, an amplifier circuit 21, an constant current feeding circuit 19 and an AD conversion circuit 22. The microcomputer 18 comprises a memory 14 for storing a predetermined sequence of control and information of control, an input circuit 15, an output circuit 16 and an arithmetic and logic unit 17 for processing the sequential operations in response to input data. The output interface 20 is to supply output signals of the microcomputer 18 to the glow relays 2A, 10A and a constant current feeding circuit 19 for feeding a current for detecting temperature. The amplifying circuit 21 amplifies the quantity of voltage drop at a predetermined level, the voltage drop being caused depending on the resistance value of the glow plug 1 which corresponds to a temperature produced in the glow plug by the detecting current supplied from the constant current supplying circuit 19. The AD conversion circuit 22 converts an output signal from the amplifying circuit 21 and a signal corresponding to the voltage applied to the glow plug when the glow relay 2A is closed, into digital signals to output to the microcomputer.

Figure 3:
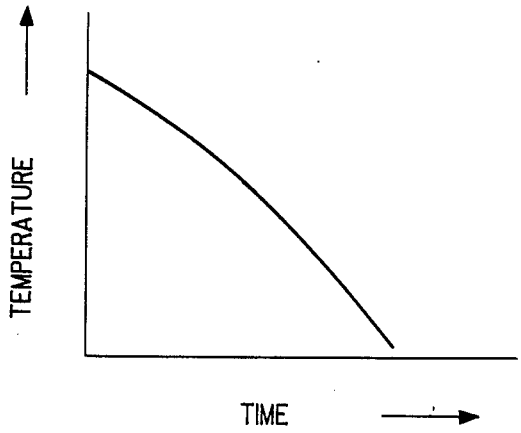
FIGS. 3 and 4 are respectively characteristic diagrams showing data stored in a controller used for the present invention.
Figure 4:
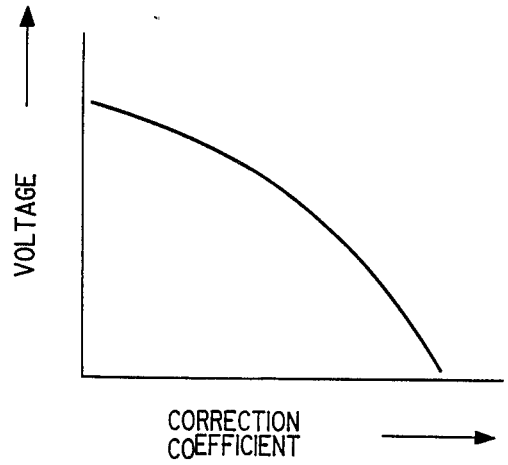
Figure 5:
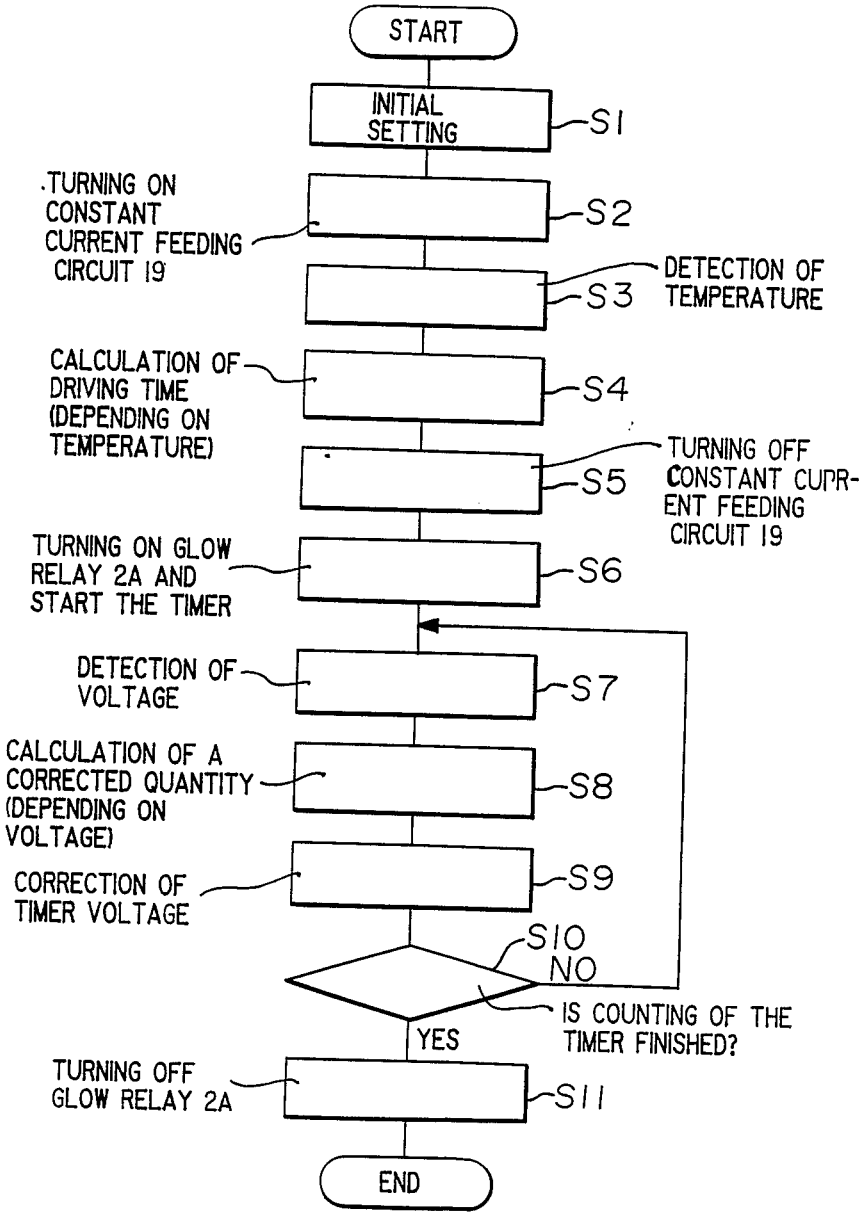
FIG. 5 is a flow chart showing the operation of the controller.

The memory 14 in the controller 13 stores data on current conducting time vs. detected temperatures as shown in FIG. 3 and correction factor characteristic corresponding to the applied voltages as shown in Figure 4. The operation of the controller 13 will be described with reference to a flow chart in FIG. 5.

Values in the controller 13 are initialized at an initial Step S1. At Step S2, the constant current circuit 19 is actuated by the microcomputer 18 through the output interface 20, whereby the constant current circuit 19 supplies a constant current previously determined to the glow plug 1 to thereby cause voltage drop in it depending on the resistance value of the glow plug 1 which corresponds to a temperature produced in the glow plug 1.

At Step S3, the amplifying circuit 21 amplifies the voltage dropped by the resistance of the glow plug, and the output of the amplifying circuit 21 is supplied to the AD conversion circuit 22 in which the voltage value is coded in a digital value to be suitably processed by the microcomputer 18.

The microcomputer 18 receives the digital value corresponding to the temperature of the glow plug 1 through the input circuit 15 and stores it in a plug temperature register addressed in the memory 14. At Step S4, a driving time for driving the glow relay 2A is calculated on the basis of the temperature detected. In the determination of the driving time, data on temperature-current feeding time characteristic are previously stored in the memory 14 are taken. The memory 14 stores the temperature-current feeding time characteristic to elevate the temperature of the glow plug at a predetermined goal temperature for controlling when the voltage of the battery 3 is at a predetermined value (such as 10.5 V). Accordingly, the driving time can be properly determined by calculation even when the initial temperature of the glow plug 1 varies.

At Step S5, the constant current feeding circuit 19 becomes off, and the sequential step goes to Step S6.

At Step S6, the glow relay 2A is turned on through the output circuit 16 and the output interface 20, and at the same time, a preheating counter in the memory 14 is cleared to zero. Then, counting is started at each predetermined reference time.

At Step S7, the voltage applied to the glow plug 1 by turning-on the glow relay 2A is converted into a digital value by the AD conversion circuit 22, and the digital value is stored in the voltage register of the memory 14.

At Step S8, a corrected quantity of driving time for the glow relay 2A is processed on the basis of the voltage of the glow plug 1 detected by the voltage detecting means, and the value of the corrected quantity is stored in the memory 14.

In the determination of the corrected quantity of driving time, data of voltage to be applied to the glow plug corresponding to a correction coefficient as shown in FIG. 4 are taken into account since the driving time obtained at Step S4 is determined on the basis of a fixed value of the voltage in the battery 3, and actual voltage varies depending on electric loads and the condition of the battery 3.

At Step S9, correction of a voltage for a preheating timer is conducted. Counting is started for the preheating timer for each predetermined reference time. The reference time is changed by the correction coefficient in inverse proportion to the applied voltage in such a manner that when the voltage is high, the reference time is made short so that the operation of the timer is shortened, and when the voltage is low, the reference time is prolonged to thereby prolong the operation time of the timer. Thus, the temperature of the glow plug 1 can be properly controlled to give a predetermined value even though the voltage applied to the glow plug 1 varies.

At Step S10, determination is made as to whether or not counting of the predetermined time by the preheating timer is finished, the time being previously determined at Step S4. When the time is not counted, the sequential step returned to Step S7. Thus, the temperature of the glow plug 1 is controlled.

When the counting operation by the preheating timer is finished, then, the glow relay 2A is off at Step S11. Thus, the controlling operations are completed.

The above-mentioned description concerns the operation of the quick preheating circuit.

In the following, description will be made as to the operation of controlling of the stable preheating circuit consisting of the resistor 11 and the second switch element 10.

The stable preheating circuit is such that after the temperature of the glow plug 1 is elevated to a predetermined temperature by applying an excessive voltage higher than a rated value by the quick preheating circuit, the first switch element 2 is opened, and at the same time, the second switch element 10 is closed to insert the resistor 11 in series to the glow plug 1, whereby the voltage applied to the glow plug 1 is reduced to about the rated value to thereby maintain the temperature of the glow plug 1 in a lower range.

Figure 6:
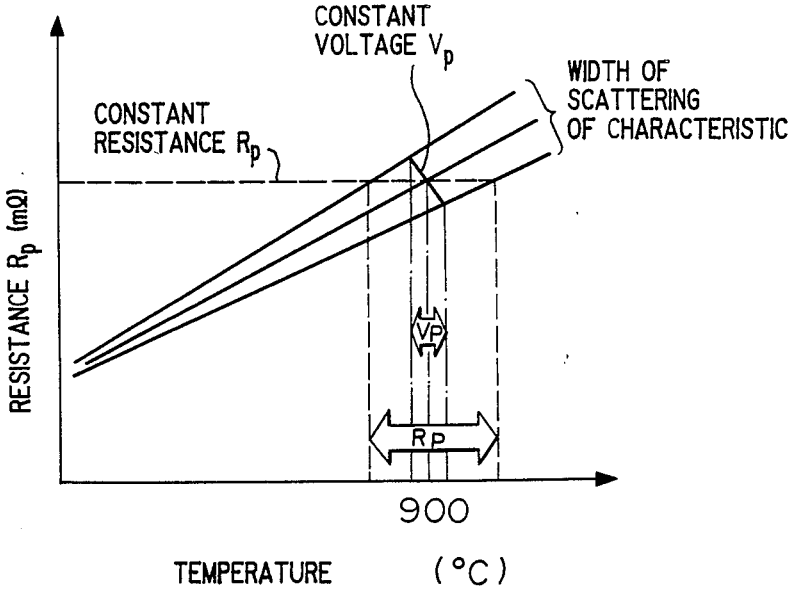
FIG. 6 is a characteristic diagram showing a relation between the resistance value of a glow plug and temperature in the embodiment of the present invention.

FIG. 6 shows temperature-resistance characteristic of the glow plug 1. In FIG. 6, three characteristic lines indicate the width of scattering in the characteristic of the glow plug. Broken lines represent the width RP in temperature of the glow plug 1 when the resistance of the glow plug 1 is considered to be constant. One dotted chain lines represent the width Vp in temperature of the glow plug 1 when a constant voltage is applied to the glow plug. It is confirmed that the width of temperature obtained by maintaining the voltage applied to the glow plug to be constant is smaller than the width of temperature obtained by detecting a fixed resistance value.

From the viewpoint of the above-mentioned, in the present invention, the voltage applied to the glow plug 1 is detected in normal operation by the voltage detecting means 6 during a stable preheating period, and when the applied voltage reaches the voltage corresponding to a predetermined temperature, current feeding to the glow plug 1 is stopped to thereby avoid the overheating of the glow plug 1. Further, when it is necessary to continuously observe the temperature of the glow plug 1, the stable preheating circuit is operated again after a predetermined time so that the above-mentioned sequential steps are repeated, whereby the temperature of the glow plug 1 is controlled at its upper limit temperature or near.

Figure 7:
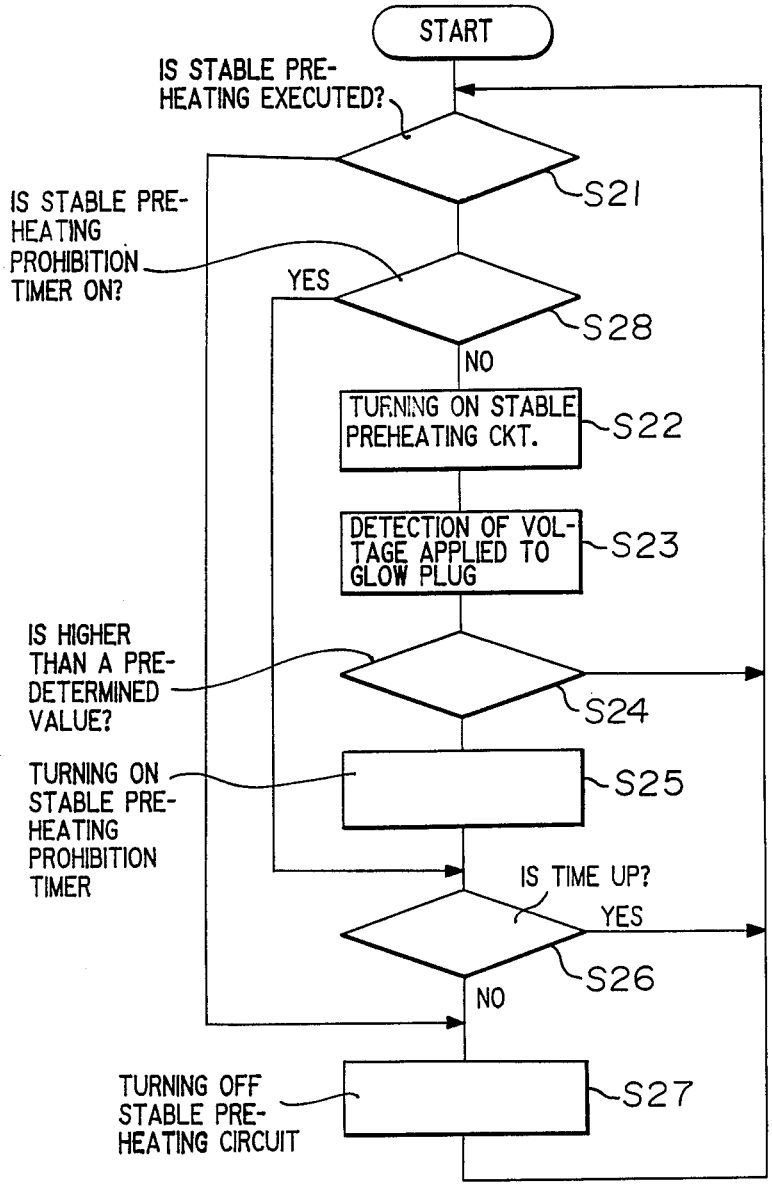
FIG. 7 is a flow chart showing the operation of the glow plug in a stable preheating operations which is controlled by the controller.

The operation of the stable preheating circuit will be described with reference to a flow chart in FIG. 7.

First of all, determination is made as to whether or not a stable preheating runs at Step 21. When it is "NO", a signal is supplied from the microcomputer 18 in the controller 13 through the output interface 20 to the glow relay 10A to break current feeding to the glow plug 1 at Step S27.

When "YES", there is taken Step S28 at which determination is made as to whether or not a timer to prohibit stable preheating operation is operated, the timer being to determine a time for prohibiting current feeding in a stable preheating control time period. In the stable preheating control period, the timer is in an off state. When the timer is found to be off, then the sequential step goes to Step S22 at which the microcomputer 18 turns on the glow relay 10A through the output interface 20 so that the resistor 11 is inserted in series to the glow plug 1 and the battery 3. At the same time, the output of the microcomputer 18 turns off the glow relay 2A through the output interface 20. After the glow relay 2A is off, the timer in the memory 14 keeps the glow relay 10A to be in an ON state for a predetermined time period. Thus, the controlling operation is changed to a stable preheating mode so that the temperature of the glow plug 1 is maintained.

At Step S23, the voltage detecting means 6 detects the voltage applied to the glow plug 1. At Step S24, determination is made as to whether the voltage applied to the glow plug 1 reaches a predetermined value or higher than a predetermined voltage corresponding to the temperature. When the voltage is lower than the set value, the sequential step is returned to Step S21 so that the operations of Steps S21, S28, S22, and S23 are repeated.

When the voltage applied to the glow plug 1 reaches the set value at Step S24, the timer for prohibiting the stable preheating operation in the memory 14 is turned on to start time-counting at Step S25. At Step S26, determination is made whether or not the counting is finished. If not, the sequential step goes to Step S27.

At Step S27, the microcomputer 18 supplies a signal to the glow relay 10A through the output interface 20 to turn off the glow relay 10A. Accordingly, the operation of the stable preheating circuit comprising the resistor 11 and the second switch element 10 is stopped to thereby stop the current feeding to the glow plug 1. Thus, the overheating of the glow plug 1 is avoidable.

When the timer for prohibiting stable preheating operation is in an ON state at Step S28, then, the sequential step goes to Step S26. The above-mentioned sequential steps are repeated until the timer for prohibiting stable preheating operation finishes the counting operation, during which the glow relay 10A is kept to be off for a predetermined time.

At Step S26, when the timer finishes the counting operation, the timer becomes off, and the sequential step goes from Step S26 to Step S21 and then Step S28. Since the timer is in off state, the glow relay 10A is again turned on at Step S22. Thus, the sequential Steps S21 through S24 are repeatedly executed until the voltage applied to the glow plug 1 reaches a predetermined voltage corresponding to the set temperature.

As described above, the voltage applied to the glow plug 1 is continuously detected during the stable preheating time period. When the voltage reaches the predetermined value, the current feeding to the glow plug is stopped to thereby prevent the overheating of the glow plug 1.

When it is necessary to maintain the temperature of the glow plug 1 at a predetermined value, the glow relay 10A is turned on to operate the stable preheating circuit by an instruction signal from the microcomputer 18 through the output interface 20. Then, the sequential steps from Step S21 to Step S27 are repeated, whereby the temperature of the glow plug 1 is maintained at or near the upper limit temperature.

Thus, in the present invention, the stable preheating circuit comprising a resistor and a switch element is connected in parallel to the quick preheating circuit so that a voltage applied to the glow plug is detected by the voltage detecting means when a stable preheating operation is conducted for the glow plug by the operation of the stable preheating circuit. When the voltage applied to the glow plug reaches the predetermined voltage corresponding to a predetermined temperature, the operation of the stable preheating circuit is stopped. Accordingly, the upper limit temperature of the glow plug can be precisely detected without using a special temperature detecting means. When an excessive voltage higher than a practically allowable voltage is applied to the glow plug, the temperature of the glow plug can be controlled to be low. Further, the construction of the glow plug control apparatus is simple and it has a low manufacturing cost.

Obviously, numerous modifications and variations of the present invention are possible in light of the above teachings. It is therefore to be understood that within the scope of the appended claims, the invention may be practiced otherwise than as specifically described herein.

What is claimed is:

1. A glow plug controlling apparatus for a diesel engine comprises:

a glow plug having a predetermined resistance-temperature characteristic which is mounted on said diesel engine and in which a rated value of voltage applied thereto is determined to be lower than a power source voltage, a quick preheating circuit comprising a first switch element connected in series between said glow plug and a power source, a stable preheating circuit comprising a serial connection of a resistor and a second switch element which is connected in parallel to said quick preheating circuit, a voltage detecting means for detecting a voltage applied to said glow plug when said second switch element of the stable preheating circuit is closed, and a controller means including driving signal controlling means for determining a driving time to drive said second switch element in response to an output from said voltage detecting means, said controller means further including a constant current circuit means to feed a constant current to said glow plug at an opening time of said first and second switch elements, a temperature detecting means for measuring the resistance value of said glow plug by detecting the voltage drop in the glow plug wherein said resistance value corresponds to the temperature of said plug, current feeding means for feeding current to said glow plug including means for controlling said current feeding means in order to elevate the temperature of said plug on the basis of said resistance value, wherein said means for controlling said current feeding means further includes a means for turning on said first switch element and measuring a resultant terminal voltage of said plug during the ON time of said first switch element in order to correct and control said current feeding time on the basis of said detected terminal voltage.

2. The glow plug controlling apparatus according to claim 1, wherein said stable preheating circuit is actuated after said quick preheating circuit is deenergized.

3. The glow plug controlling apparatus according to claim 1, wherein said stable preheating circuit stops to supplying an electric power to said glow plug when a voltage applied to said glow plug which is detected by said voltage detecting means reaches the voltage corresponding to a predetermined temperature.

4. The glow plug controlling apparatus according to claim 3, wherein the deenergization and the actuation of said stable preheating circuit are repeated to keep the temperature of said glow plug at an upper limit.

* * * * *